United States Patent [19]

Nakajima et al.

[11] 4,127,303

[45] Nov. 28, 1978

[54] COAL MINING METHOD AT A LONG-WALLED PIT FACE OF THE COAL MINE

[75] Inventors: Shigeo Nakajima, Tokyo; Hajime Endo, Kushiro, both of Japan

[73] Assignee: Taiheiyo Engineering Incorporated, Tokyo, Japan

[21] Appl. No.: 764,792

[22] Filed: Feb. 2, 1977

[30] Foreign Application Priority Data

Aug. 31, 1976 [JP] Japan ..... 51-103977

[51] Int. Cl.[2] ..... E21C 41/00; E21C 35/14

[52] U.S. Cl. ..... 299/11; 299/31; 299/33

[58] Field of Search ..... 299/11, 31, 32, 33, 299/43; 61/45 D

[56] References Cited

U.S. PATENT DOCUMENTS 3,677,603 7/1972 Small ..... 299/31

3,896,626 7/1975 Spies et al. ..... 61/45 D

FOREIGN PATENT DOCUMENTS 1,145,743 3/1969 United Kingdom ..... 299/43

*Primary Examiner*—Ernest R. Purser

*Attorney, Agent, or Firm*—Frank J. Jordan

[57] ABSTRACT

A coal mining method at a long-walled pit face of a coal mine comprises combining self-advancing supports with a conveyor which is arranged along the long-walled pit face and on which a shearer is mounted, and arranging the effective shearing depth of shearing drums of the shearer to be at least half as long as the stroke of a shifter for shifting both of the self-advancing supports and the conveyor toward the pit face, whereby each of the self-advancing supports is progressively shifted toward the pit face every time that the whole area of the pit face is sheared at least twice by the shearer.

3 Claims, 6 Drawing Figures

COAL MINING METHOD AT A LONG-WALLED PIT FACE OF THE COAL MINE

The present invention relates to a coal mining method at a long-walled pit face of a coal mine and, more particularly, a coal mining method enabling the whole area of the pit face to be sheared in such a way that each of the self-advancing supports arranged along the pit face is progressively shifted toward the pit face every time that the shearing operation of the shearer is performed twice.

Not to mention the case under which inside labor in floating coal dust is prohibited by regulations, laborers have to operate the self-advancing supports at the windward side of the shearer so as to protect their health when the coal mining machine such as the ranging drum shearer or the like is in operation. Accordingly, the shearer is always forced to perform its shearing operation in one direction, that is, from the windward side to the leeward side, and when the shearer comes, shearing, to the leeward side end of the pit face or the coal bed, the shearer must be returned, not shearing, to the gate located at the windward side of the coal bed. This is one shearing cycle of the conventional shearers which have been employed to attain a coal mining method, the so-called one returning process after one shearing operation.

On the other hand, when there is employed the two way coal mining method of forcing the shearer to travel, shearing, from the leeward side to the windward side, operators must stop for awhile, due to the reason as described above, their operation of the self-advancing supports until the shearer reaches the gate located at the windward side and floating coal dust is exhausted from the pit face by ventilation. As a result, one shearing cycle of the shearer needs too much time to achieve high productivity.

When the whole area of the coal bed is to be sheared at a time by a conventional drum shearer having shearing drums provided at both sides of the front face thereof, it needs two operators and one of them is always forced to watch and operate the other of the drums in floating coal dust, thus impairing his health. Further, in the case in which inside labor in floating coal dust is prohibited, both of the shearing drums must be watched and operated by only one operator standing at the windward side, so that the shearing speed is limited and the floor of the sheared coal bed is often left uneven to cause the subsequent shearing operation troublesome.

It is, therefore, an object of the present invention to provide a coal mining method enabling the above-mentioned drawbacks to be eliminated and the shearing reciprocation of the shearer to be attained synchronously with the operation of the self-advancing supports even in the case where inside labor in floating coal dust is prohibited.

Figure 1:
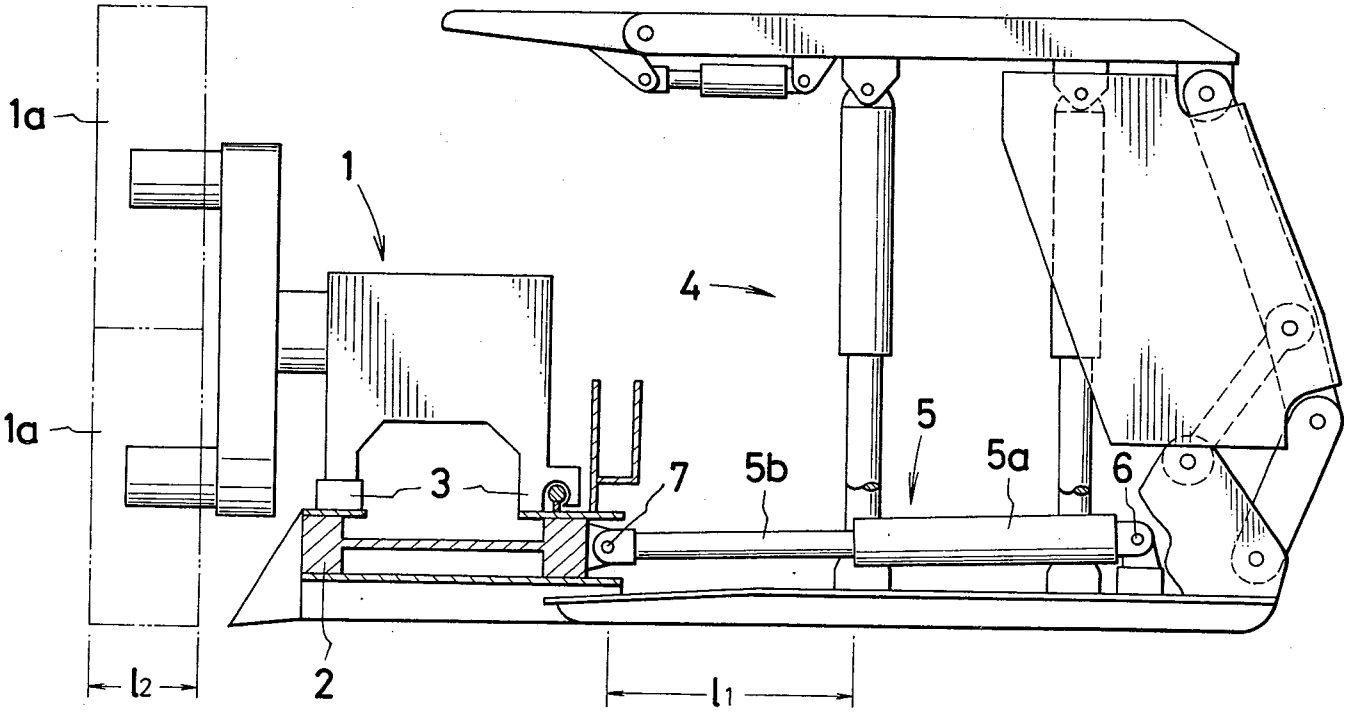
FIG. 1 is a side view showing an example of the shearer and the self-advancing supports which are employed to achieve a coal mining method according to the present invention.

FIG. 1 is a side view of a shearer and self-advancing supports which are employed to attain the coal mining method of the present invention, and in the Figure numeral 1 denotes a drum shearer body having two shearing drums 1*a* and 1*a* provided at one side of the front face thereof. The drum shearer body 1 houses a driving means therein and is mounted on a conveyor 2 with a sledge interposed therebetween. Numeral 4 represents self-advancing supports arranged along the conveyor 2, and numeral 5 a shifter for shifting the conveyor 2 and self-advancing supports 4. The shifter 5 comprises a hydraulic cylinder 5*a* and a piston rod 5*b*. The back end of the hydraulic cylinder 5*a* is secured by a pin 6 to the base of the self-advancing supports, while the front end of the piston rod 5*b* is secured by a pin 7 to the conveyor 2. The stroke $1_1$ of the shifter 5 is arranged to be at least twice the depth $1_2$ at which the coal bed is sheared by the shearing drums 1*a* and 1*a*. While maintaining the self-advancing supports stationary, the conveyor 2 can be forwarded at least twice the shearing depth $1_2$.

Figure 2A:
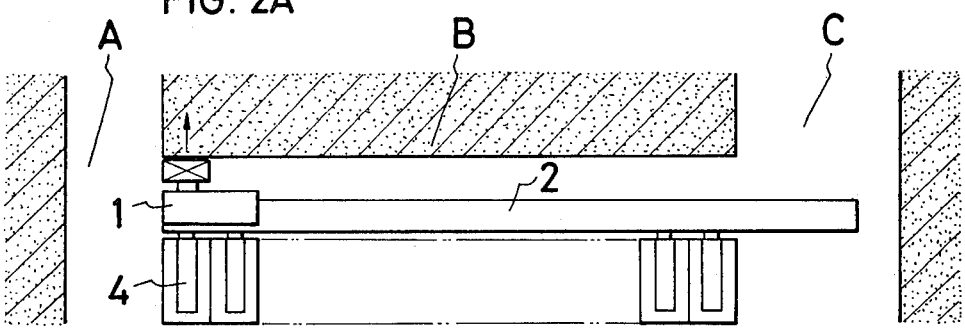
FIGS. 2A through 2E are plan views showing how the shearer and the self-advancing supports are respectively located as they perform the coal mining method of the present invention.
Figure 2B:
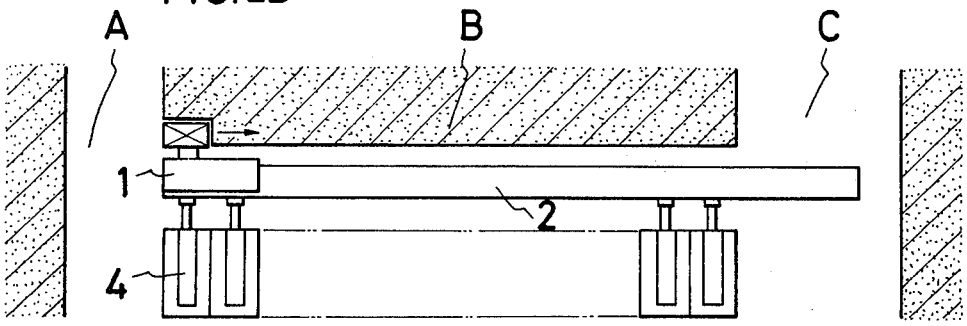
Figure 2C:
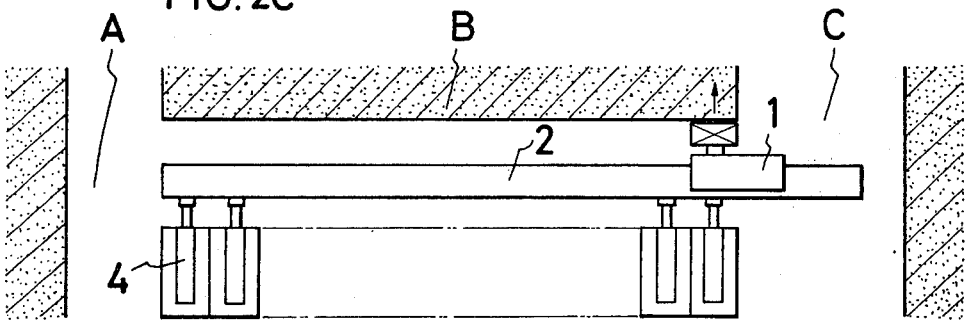
Figure 2D:
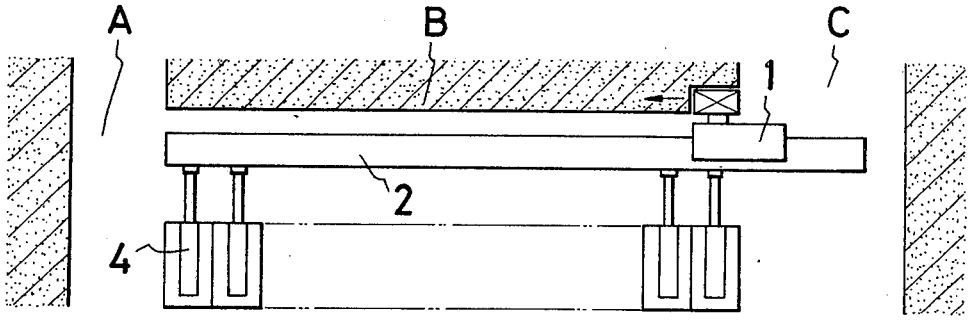
Figure 2E:
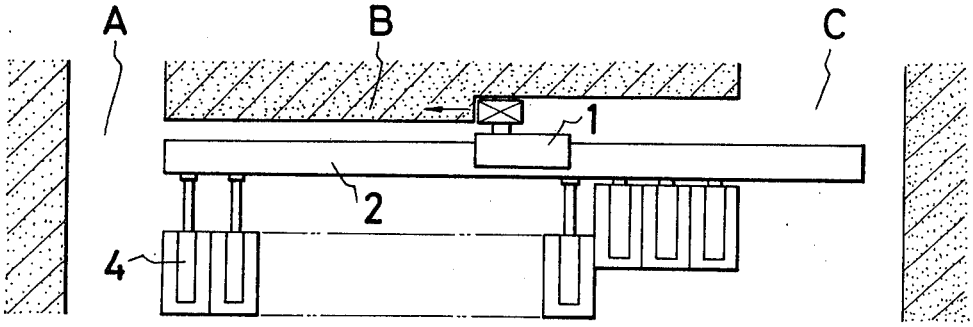

Referring to FIGS. 2A through 2E, the coal mining method of the present invention which is attained by the shearer and the self-advancing supports will not be described. In FIG. 2A, the shearer 1 is located at a side end A and the conveyor 2 is then shifted by the shifter 5 about one half the shearing depth or the stroke $1_2$ of the shifter 5. As the conceyor 2 is shifted like this, the shearer 1 is forced to shear into the coal bed B to take the position shown in FIG. 2B. The shearer 1 starts from this position to shear the coal bed B to a gate side end C in the direction shown by the arrow in FIG. 2B and advances to the position shown in FIG. 2C. After the shearer 1 reaches the gate side end C, the conveyor 2 is further advanced forwardly by the shifter 5 in same way as described with reference to FIG. 1, and the shearer 1 is forced to shear into the coal bed B to take the position shown in FIG. 2D. Then, the shearer 1 starts to shear the coal bed B in the direction shown by the arrow in FIG. 2D. FIG. 2E shows how the self-advancing supports 4 arranged at the gate side C of the shearer 1 are progressively shifted toward the coal bed B as the shearer 1 develops its shearing operation to the side end A. The distance at which the self-advancing supports 4 are shifted toward the coal bed B is about twice the shearing depth $1_2$ and is approximately equal to the stroke $1_1$ of the shifter 5.

According to the coal mining method of the present invention, the self-advancing supports are shifted every time that the shearer completes one shearing reciprocation, so that the operator of the shearer can take his position always at the windward side to operate the shearer and the other operator watching the self-advancing supports shifted can keep his position always at the windward side. Therefore, the coal mining method of the present invention enables the operators' health to be protected and the productivity to be greatly enchanced.

It will be understood that the shearer and the self-advancing supports which are employed to attain the coal mining method of the present invention are not limited to those such as described above referring to the Figures. In the preferred embodiment the shearer having two shearing drums provided at one end of the front face threof is employed to shear by its reciprocation the whole area of the coal bed twice the shearing depth of the drums. However, depending on the type of the shearer and the coal bed structure, there is a case where the whole area of the coal bed can not be sheared to a depth twice the effective shearing depth $1_2$ of the drums unless the shearer is reciprocated more than three times, and it will be apparent that the description relative to the preferred embodiment does not exclude this case from the coal mining method of the present invention.

What is claimed is:

1. A coal mining method used at a long-walled pit face of a coal mine and utilizing a shearer having at least one drum rotatable about an axis disposed generally perpendicular to the pit face and further utilizing self-advancing supports comprising:

reciprocating the shearer from a first position on one side of the pit face to another side of the pit face in one direction parallel to the pit face as the shearing drum shears the pit face;

maintaining the self-advancing supports in a first location as the shearer is reciprocated in said one direction;

stopping the shearer at a second position upon reaching the end of the reciprocating stroke at said other side of said pit face;

advancing said shearer perpendicular to the pit face while the shearer is at said second position, said advancing being effected by a shifter operably connected between said shearer and said self-advancing support;

maintaining said self-advancing supports at said first location while effecting said last step of advancing said shearer perpendicularly to the pit face such that the shearer moves further away from the self-advancing support;

reciprocating the shearer from said second position on the other side of said pit face to said first position on said one side of said pit face in an opposite direction parallel to the pit face as the shearer drum shears the pit face;

advancing said self-advancing supports from said first location toward said pit face to a second location, said latter advancing step being effected on the self-advancing supports disposed between said reciprocating shearer and said second position on said other side of said pit face such that said self-advancing supports are advanced at locations downstream of said reciprocating shearer as the latter moves toward said first position;

stopping the shearer at said first position upon reaching the end of the reciprocating stroke at said one side of said pit face;

advancing said shearer perpendicular to the pit face while the shearer is in said first position, said latter advancing step being effected by said shifter;

maintaining said self-advancing supports at said second location while effecting said last step of advancing said shearer perpendicularly to the pit face such that the shearer moves further away from the self-advancing support; and repeating the aforementioned steps in the sequence set forth such that the self-advancing supports are advanced upon every two complete reciprocating strokes of said shearer.

2. A coal mining method according to claim 1, further comprising the steps of providing an advancing stroke on the shifter to be at least twice the effective shearing depth of the shearing drum.

3. A coal mining method according to claim 1, wherein said shifter is interposed between said shearer and said self-advancing supports, said shifter being a piston operable within a cylinder, further comprising the step of providing a piston stroke equal to a least twice the effective shearing depth of the drum.

* * * * *